US006803531B2

(12) United States Patent
Müller et al.

(10) Patent No.: US 6,803,531 B2
(45) Date of Patent: Oct. 12, 2004

(54) ELECTRICAL SWITCH FOR VEHICLE LIGHTING

(75) Inventors: Klaus Müller, Aach (DE); Jürgen Girke, Gaienhofen (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 0 days.

(21) Appl. No.: 10/073,432

(22) Filed: Feb. 11, 2002

(65) Prior Publication Data

US 2002/0121431 A1 Sep. 5, 2002

(30) Foreign Application Priority Data

Feb. 12, 2001 (DE) ..... 101 06 645
Feb. 16, 2001 (DE) ..... 101 07 363

(51) Int. Cl.[7] ..... H01H 25/06
(52) U.S. Cl. ..... 200/4; 200/7; 200/14; 200/542
(58) Field of Search ..... 200/542, 4, 7, 200/9, 18

(56) References Cited

U.S. PATENT DOCUMENTS 3,619,519 A * 11/1971 Wiggins ..... 200/4
4,225,758 A * 9/1980 Kondo et al. ..... 200/4
4,349,711 A * 9/1982 Lake ..... 200/542
6,570,105 B1 * 5/2003 Sallam et al. ..... 200/18

FOREIGN PATENT DOCUMENTS

| | | | |
|---|---|---|---|
| DE | 4117031 | A1 | 11/1991 |
| DE | 19503902 | A1 | 8/1996 |
| DE | 19547343 | A1 | 6/1997 |
| DE | 19721514 | A1 | 11/1997 |
| EP | 1037231 | A2 | 3/2000 |

* cited by examiner

*Primary Examiner*—Renee Luebke
(74) *Attorney, Agent, or Firm*—Tarolli, Sundheim, Covell & Tummino L.L.P.

(57) ABSTRACT

The electrical turn/pull switch for vehicle lighting has an operating part (14) that is mounted in a switch housing (12) so as to be rotatable as well as axially movable. The movable contact elements (22, 24, 26) of a contact carrier (20) interact with fixed contact elements (30). The contact elements for the turn switch function (22) and for the axial switch function (24, 26) are integrated on the contact carrier (20). An actuation part (16) entrained by the operating part (14) has cams and/or ramps (18) that engage the movable contact elements (24, 26) and actuate them.

6 Claims, 4 Drawing Sheets

ELECTRICAL SWITCH FOR VEHICLE LIGHTING

TECHNICAL FIELD

The present invention relates to an electrical switch for vehicle lighting, having an operating part that is mounted in a switch housing so as to be rotatable as well as axially movable.

BACKGROUND OF THE INVENTION

With conventional electrical turn/pull switches for vehicle lighting, for example, the parking lights and the low beams can be activated by turning a turn/pull switch in successive steps, and the front and rear fog lights are activated by successive stepped movements in an axial direction. The electrical connections for the rotational and for the axial switching functions are established by means of two different switching devices, for example, by a contact slider in the rotational switch function and by additional micro-switches in the axial switch functions.

BRIEF SUMMARY OF THE INVENTION

The invention provides an electrical turn/pull switch that can be economically manufactured and assembled.

According to the invention, an electrical turn/pull switch is provided for controlling operation of lighting in a vehicle. The switch has a switch housing, an actuating member mounted for rotation about a central axis and for axial movement within the switch housing, and a movable contact carrier coupled to the actuating member for joint rotation and relative axial movement. A fixed contact carrier is mounted in the switch housing in a position axially opposite to the movable contact carrier. A first set of movable contacts are mounted on the movable contact carrier and associated with a first set of fixed contacts of the fixed contact carrier. A second set of movable contacts are mounted on the movable contact carrier and associated with a set of radially fixed contacts also mounted on the movable contact carrier in positions radially opposite to corresponding ones of the movable contacts of the second set. At least one cam is provided on the actuating member. The cam is movable axially between a first position disengaged from a corresponding movable contact of the second set and a second position engaged with the movable contact of the second set to deflect the contact radially against a corresponding contact of the set of radially fixed contacts. Since the contact elements integrated on the contact carrier are involved in both switch functions, rotational and axial, it is possible to dispense with the higher expenditures for the production or purchase and assembly of micro-switches that are additionally needed in conventional turn/pull switches for the axial switch function.

BRIEF DESCRIPTION OF THE DRAWINGS

Additional features and advantages of the invention ensue from the following description of a preferred embodiment and from the appended drawings, to which reference is made. The drawings show the following.

DETAILED DESCRIPTION OF THE PREFERRED EMBODIMENTS

Figure 1:
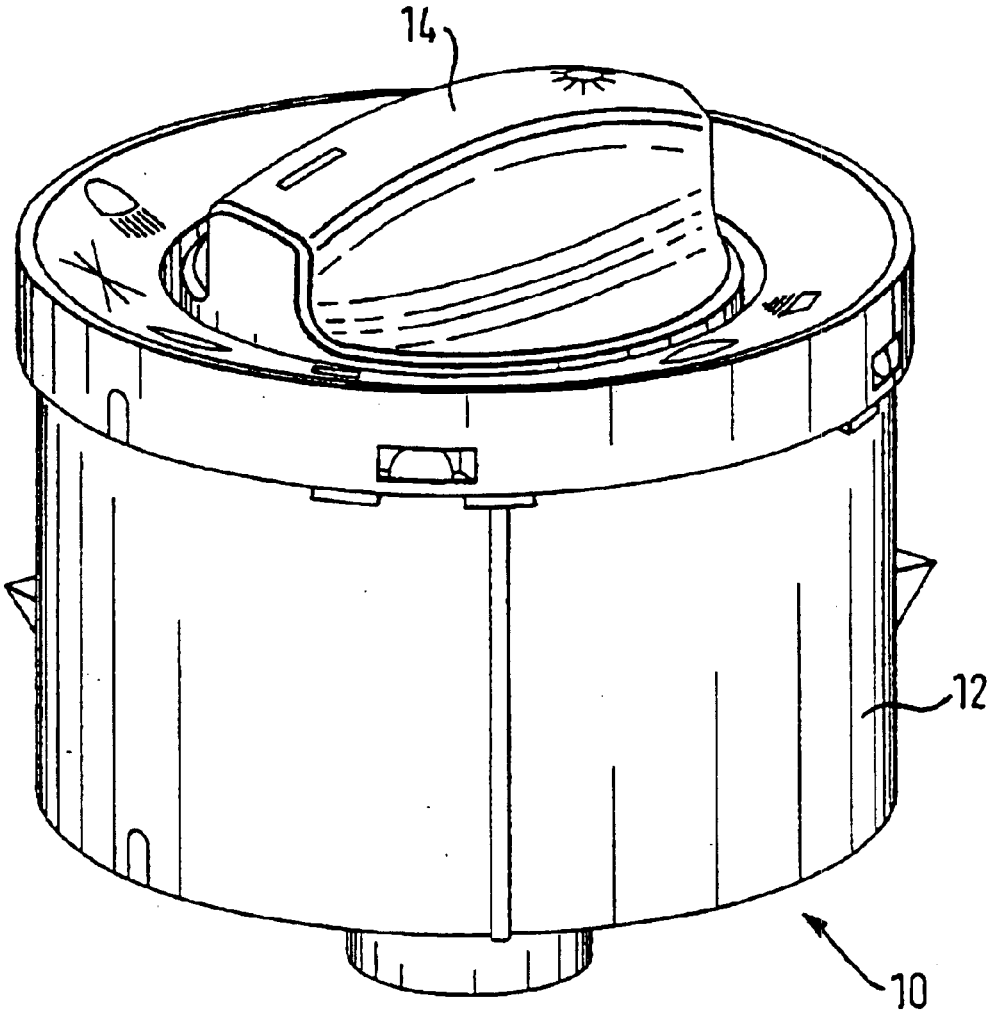
FIG. 1—a perspective view of an electrical turn/pull switch according to the invention in a preferred embodiment FIG. 2 —a view of a contact carrier with contact elements of the turn/pull switch according to the invention of FIG. 1.

The electrical turn/pull switch 10 shown in FIG. 1 has a generally cylindrical switch housing 12 and, as a manual operating member, a turn/pull button 14. The turn/pull button 14 is coupled to an actuating member referred to as a switching cross 16 (see FIG. 2) that is provided with axially extending actuation ramps 18. The contact elements for the rotational switch function and for the axial switch function are integrated on a shared contact carrier plate 20. They are preferably formed by being punched out of a shared plate, for example, from a gold-plated metal strip. Particular punched-out contact elements or areas are subsequently bent as needed. Thus, a contact element 22 corresponds to the contact element for the rotational switch function and the contact elements 24, 26 correspond to the contact elements for the axial switch function. The contact element 22 is punched out in such a way that a first and second contact pair 22*a*, 22*b* as well as a first and second contact tag 34, 36 are formed. Contact elements 24, 26 each have a contact tag 24*a* and 26*a* respectively and a contact pair 24*b* and 26*b* respectively with contact surfaces 24*c* and 26*c* respectively. The contact elements 24*b*, 26*b* of the turn switch function are punched out and bent in such a way that they make no contact with the contact element 22 of the turn switch function. The contact elements 22, 24 and 26 are attached onto the contact carrier plate 20, for example, by means of ultrasound welding. Preferably, the contact elements 22, 24 and 26 are pre-punched out of the gold-plated metal strip before being attached to the contact carrier plate 20 and bent in specific areas and, after attachment to the contact carrier plate 20, are punched free as needed for the envisaged function.

Figure 2:
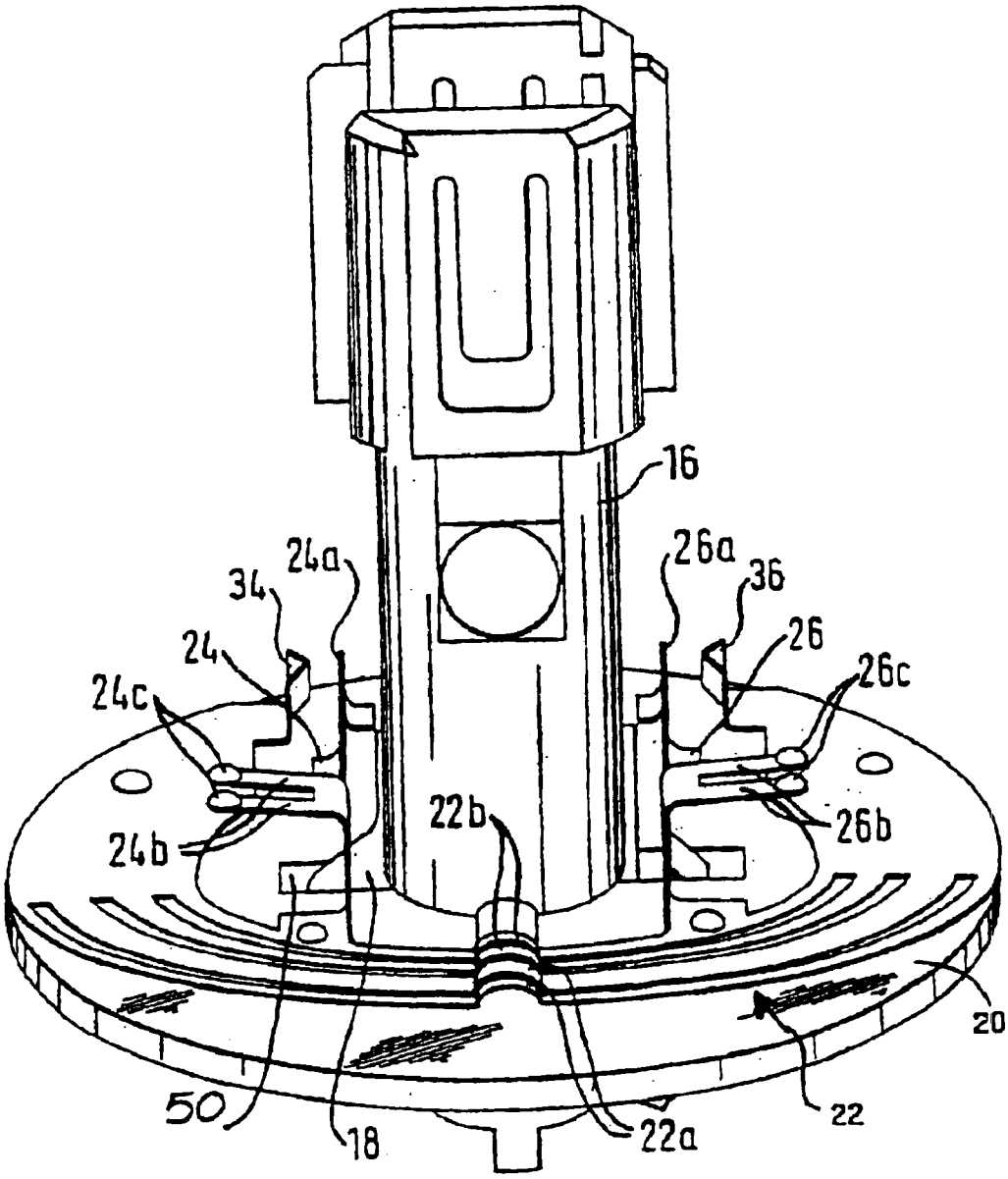
Figure 3:
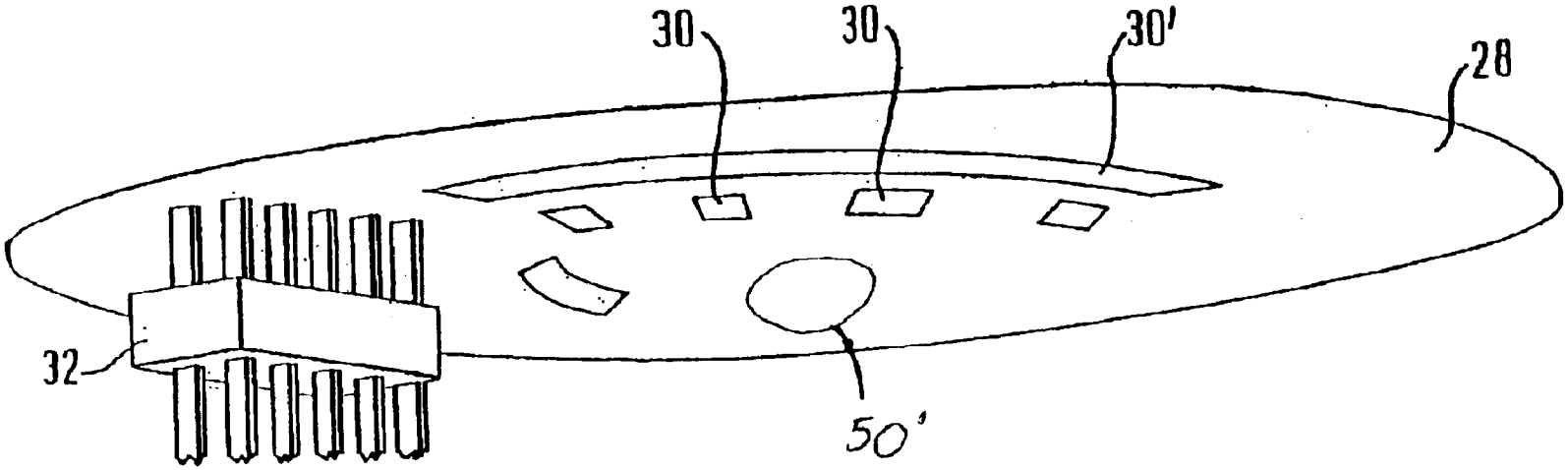
FIG. 3 —a perspective view of a printed circuit board on which contact paths that interact with the contact elements are laid out.
Figure 4:
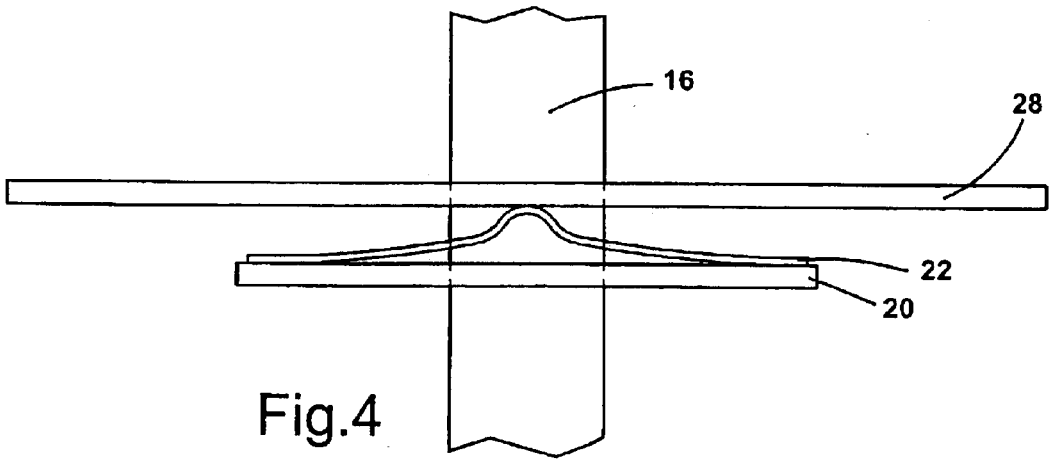
FIG. 4—a schematic side view of the electrical turn/pull switch with parts omitted.

Relative to FIG. 2, above the contact carrier plate 20, there is a printed contact board 28 shown in FIG. 3 with fixed contact elements that are configured as sliding paths 30 that are electrically insulated from each other. The individual sliding paths 30 are each electrically connected with associated contacts of a plug 32. In the assembled state, the contact carrier plate 20 and the printed circuit board 28 are arranged in such a way with respect to each other that the contact pairs 24, 26 on their contact surfaces 24*c*, 26*c*, as well as the contact pairs 22*a*, 22*b* touch the printed circuit board 28. As can be seen in FIG. 2 the contact element 22 is bent in particular areas, upwards relative to FIG. 2, so that the contact element 22 in this area does not make contact with the contact carrier plate 20.

Referring to FIG. 2, the carrier plate 20 and actuator 16 are coupled together for joint rotational movement when the ramp 18 of actuator 16 is located in the aperture 50 of the carrier plate 20. The actuator 16 moves axially relative to the carrier plate 20 through the aperture 50 and relative to the printed circuit board 28 through aperture 50'. The carrier plate 20 is supported by the housing 12. When the turn/pull button 14 is rotated, the contact carrier plate 20, together with the contact elements 22, 24 and 26 that are attached to it, moves relative to the printed circuit board 28. As a result, the contact pairs 22*a*, 22*b* of the turn switch function, which are in contact with the printed circuit board, as well as the contact surfaces 24*c*, 26*c* of the contact pairs 24*b*, 26*b* of the axial switch function, slide on the printed circuit board. Depending on the rotational position of the turn/pull switch, either the contact pair 22*a* or the contact pair 22*b* can be in contact with one of the sliding paths 30 of the printed circuit board 28. In this way, the contact pairs 22*a*, 22*b* create a conductive connection between the sliding paths that are correspondingly contacted by the contact pairs 22*a*, 22*b*. Depending on which of the sliding paths 30 are bridged, the various types of vehicle lighting that can be operated by means of the turn switch function are then activated.

In a normal non-activated condition of the axial switches the ramps 18 are disengaged from the associated movable contacts, i.e. contact tags 24*a* and 26*a*.

When button 14 is pulled to a first axial switch position, i.e. in an upward direction in FIG. 1, the ramps 18 on the switching cross 16 interact with the contact tag 24*a* to radially deflect tag 24a against the opposite radially fixed contact tag 34, which is bent upwards relative to FIG. 2, and which is formed on the contact element 22. When button 14 is pulled to a second axial position, the contact tag 26*a* is additionally deflected against the opposite radially fixed contact tag 36, upwards relative to FIG. 2, which is also formed on the contact element 22. (The ramp needed for this cannot be seen in FIG. 2 since it is located underneath the contact carrier plate 20 relative to FIG. 2.) Moreover, the contact elements 24, 26 on the contact surfaces 24*c*, 26*c* of the contact pairs 24*b*, 26*b* are each in contact with one of the sliding paths of the printed circuit board 28, so that an electrical connection between the contact elements 24, 26 and the individual contacted sliding path is established. In this fashion, depending on the axial position of the turn/pull switch, various vehicle lighting functions can be controlled. neath the contact carrier plate 20 relative to FIG. 2.) Moreover, the contact elements 24, 26 on the contact surfaces 24*c*, 26*c* of the contact pairs 24*b*, 26*b* are each in contact with one of the sliding paths of the printed circuit board 28, so that an electrical connection between the contact element 22 and the individual contacted sliding path is established. In this fashion, depending on the axial position of the turn/pull switch, various vehicle lighting functions can be controlled.

The contact surfaces of the individual contact elements 22, 24 and 26 of the contact carrier plate 20, which interact with the sliding paths 30 of the printed circuit board 28, are each configured as pairs so that, even if one of the two contact surfaces gets inefficient due to penetration of extraneous matter, the function of the contact elements is still ensured.

Since, in contrast to the turn/pull switches known from the state of the art, the axial switch function as well as the turn switch function are effectuated via contact elements located on a contact carrier plate without a need for additional individual components such as, for example, microswitches, the invention provides a turn/pull switch that is inexpensive to manufacture and to assemble.

The various switching positions of the turn switch function can be associated, for example, with the parking light and the low beams of a vehicle. The two switching positions of the axial switch function can then be associated, for instance, with the fog headlights and the rear fog light.

What is claimed is:

1. An electrical switch for controlling operation of lighting in a vehicle, comprising a switch housing, an actuating member mounted for rotation about a central axis and for axial movement within said switch housing, a movable contact carrier coupled to said actuating member for joint rotation and relative axial movement, a fixed contact carrier mounted in said switch housing in a position axially opposite to said movable contact carrier, a first set of movable contacts mounted on said movable contact carrier and associated with a first set of fixed contacts of said fixed contact carrier, a second set of movable contacts mounted on said movable contact carrier and associated with a set of radially fixed contacts also mounted on the movable contact carrier in positions radially opposite to corresponding ones of said movable contacts of the second set, and at least one cam on said actuating member, said cam being movable axially between a first position disengaged from a corresponding movable contact of the second set and a second position engaged with said movable contact of the second set to deflect said contact radially against a corresponding contact of the set of radially fixed contacts.

2. The electrical switch of claim 1, wherein said cam is ramp-shaped.

3. The electrical switch of claim 1, wherein at least two axially spaced cams are provided on said actuating member.

4. The electrical switch of claim 1 wherein said contacts carried by said movable contact carrier are all stamped from a shared metal plate.

5. The electrical switch of claim 4, wherein said radially fixed contacts and said movable contacts of the second set extend generally axially.

6. The electrical switch of claim 1, wherein said fixed contact carrier is a printed circuit board and said fixed contacts are formed by conductor tracks on said printed circuit board.

* * * * *